US005915448A

United States Patent [19]

Schulte

[11] Patent Number: 5,915,448

[45] **Date of Patent: *Jun. 29, 1999**

[54] CURTAIN BOTTOM TENSIONING ASSEMBLY

[75] Inventor: Peter S. Schulte, E. Dubuque, Ill.

[73] Assignee: Rite-Hite Holding Corporation, Milwaukee, Wis.

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/825,958

[22] Filed: Apr. 4, 1997

Related U.S. Application Data

[63] Continuation of application No. 08/437,853, May 9, 1995, abandoned, which is a continuation-in-part of application No. 08/386,743, Feb. 10, 1995, abandoned.

[51] Int. Cl.[6] ..... A47H 3/00

[52] U.S. Cl. ..... 160/271; 160/265

[58] Field of Search ..... 160/267.1, 268.1, 160/273.1, 265, 270, 271, 272, 274, 264, 322, 266

[56] References Cited

U.S. PATENT DOCUMENTS

| | | |
|---|---|---|
| 1,033,224 | 7/1912 | Andlauer . |
| 3,878,879 | 4/1975 | Manns . |
| 4,452,292 | 6/1984 | Leivenzon et al. . |
| 4,478,268 | 10/1984 | Palmer . |
| 4,569,383 | 2/1986 | Wentzel . |

(List continued on next page.)

FOREIGN PATENT DOCUMENTS

| | | |
|---|---|---|
| 125217 | 11/1984 | European Pat. Off. . |
| 1009862 | 3/1952 | France . |
| 240349 | 10/1925 | United Kingdom . |
| 503774 | 4/1939 | United Kingdom . |
| 1444017 | 4/1972 | United Kingdom . |

OTHER PUBLICATIONS

"Re–Coil Away Specifications"; M & I Door Systems Limited; Date unknown; 2 pages.

" 'Re–Coil Away' Door System Installation Instructions"; M & I Door Systems, Ltd.; May 1991; 18 pages.

"M & I Door Systems Limited" Product Brochure; M & I Door Systems Limited; Date unknown; 4 pages.

"Rytec Breaks Away" Products Brochures; Rytec Corporation; 1992; 2 pages.

"Rapid Roll Doors: The Super–Fast Solution!" Products Brochure; Albany International; 1990; 8 pages.

"Marathon Spirit" Products Brochure; Marathon Door Division—ASI Technologies; 1991; 3 pages.

"RT Series" Product Brochure; Kelley Company, Inc. 1993; 2 pages.

"Kelley Door Selection Guide"; Kelley Company, Inc.; 1993; 16 pages.

Albany International Competitor Data Sheet; Oct. 1989; 2 pages.

"Speedor" Product Brochure; Hart; Date unknown; 2 pages.

*Primary Examiner*—Blair Johnson

*Attorney, Agent, or Firm*—Marshall, O'Toole, Gerstein, Murray & Borun; Matthew C. McNeill

[57] ABSTRACT

A curtain bottom tensioning assembly comprised primarily of a resilient member extending across the bottom of the door. The resilient member is directly or indirectly coupled to a guide extension extending beyond the leading edge of the door and engaging vertical guide members to guide the door in a vertical plane. The guide extensions also engage the vertical guide members to restrict the guide extensions from moving horizontally toward the curtain. The coupling between these horizontally restricted guide extensions and the resilient member places a tension on the resilient member. The resilient member is thus stretched across the bottom of the door or curtain, and serves as a bottom bar that also substantially conforms to or deflects around an obstruction, thus preventing or minimizing damage to the door, the bottom bar and the obstruction.

26 Claims, 3 Drawing Sheets

U.S. PATENT DOCUMENTS

| | | | |
|---|---|---|---|
| 4,601,320 | 7/1986 | Taylor . | |
| 4,800,946 | 1/1989 | Rosenoy . | |
| 4,884,617 | 12/1989 | Coenraets | 160/271 |
| 4,887,660 | 12/1989 | Kraus . | |
| 4,896,714 | 1/1990 | Ellis . | |
| 5,025,847 | 6/1991 | Mueller . | |
| 5,048,588 | 9/1991 | Weishar et al. . | |
| 5,056,579 | 10/1991 | Krafutler . | |
| 5,078,197 | 1/1992 | Weishar . | |
| 5,123,474 | 6/1992 | Smith . | |
| 5,139,074 | 8/1992 | Warner . | |
| 5,139,075 | 8/1992 | Desrochers . | |
| 5,141,043 | 8/1992 | Kraeutler . | |
| 5,141,044 | 8/1992 | Hying et al. . | |
| 5,207,256 | 5/1993 | Kraeutler | 160/84.1 |
| 5,222,541 | 6/1993 | Hornberger . | |
| 5,271,448 | 12/1993 | Delgado . | |
| 5,299,617 | 4/1994 | Hying et al. . | |
| 5,353,859 | 10/1994 | Oltahfer et al. . | |
| 5,477,902 | 12/1995 | Kraeutler | 160/84.06 |
| 5,526,865 | 6/1996 | Coenraets | 160/272 |
| 5,535,805 | 7/1996 | Kellogg et al. . | |
| 5,579,820 | 12/1996 | LePage et al. | 160/268.1 |
| 5,601,133 | 2/1997 | Krupke et at. . | |
| 5,638,883 | 6/1997 | Schulte | 160/265 X |

CURTAIN BOTTOM TENSIONING ASSEMBLY

CROSS-REFERENCE TO RELATED APPLICATIONS

This is a continuation of application Ser. No. 08/437,853 filed on May 9, 1995, now abandoned which is a continuation-in-part of application Ser. No. 08/386,743 filed on Feb. 10, 1995 now abandoned.

FIELD OF THE INVENTION

The invention relates generally to doors comprising a pliable door curtain, and more particularly to an improved, adjustable soft bottom bar for a roll-up door.

BACKGROUND OF THE INVENTION

Industrial doors in which the door itself is made of pliable material such as fabric, are used in a variety of applications, typically for the purpose of separating areas within a building, or closing off building entries from the outside. Examples of such pliable doors are planar doors, overhead-storing doors and roll-up doors. Planar doors include frame members on which the fabric comprising the door is disposed. This plane of material is then movable between a doorway blocking position and a storage position, wherein the plane of material and associated frame members are disposed above the doorway. The frame typically includes extensions extending past either side of the door, and which are receivable within guide tracks to guide the door through its vertical movement. These extensions may include wheels or trolleys. An overhead-storing door is similar in that the fabric door is maintained on frame members and is movable between doorway blocking and storage positions. In this door, however, the storage position is overhead, as in a typical garage door. Accordingly, the guide members associated with such a door will curve between the vertical and horizontal. A typical roll-up door comprises a fabric curtain which is wound about a roller journalled for rotation above the doorway with which the roll-up door is associated. To close the door, the roller is rotated such that the curtain pays off of the roller to enclose the doorway. Of course, the door is opened by reversing the direction of the roller and rolling the fabric curtain onto the roller. Such roller doors are typically either powered opened and closed, or are powered open and allowed to fall closed by gravity. As the invention herein is envisioned for use primarily with roll-up doors, it will be described with reference thereto. However, the invention may also be used in combination with other such pliable doors.

When a roll-up door is placed over an exterior doorway of a building, provision must be made to prevent the fabric curtain from billowing due to wind being applied from the outside. Similarly, when the roll-up door is in place between different sections of a warehouse, there may be pressure differentials between these two sections, which may also cause billowing of the roll-up door if the door does not have provision to prevent this from happening. Such billowing may be problematic as it impedes door function and allows leakage around the door. To correct for this problem, roll-up doors typically include a rigid or semi-rigid bottom bar to help in providing what is generally referred to as "wind retention". The bottom bar typically extends across the leading width of the door, and also includes extensions which extend past either side of the door. These extensions typically engage side frames disposed on either side of the door and which run vertically along the side of the doorway.

As the door moves between its open and closed positions, the bottom bar and its extensions move within a generally vertical plane since the extensions engage and are guided along or within the generally vertical side frames. With the leading edge of the door thus restrained within a vertical plane, movement of the fabric curtain of the door out of that vertical plane is largely avoided. However, the bottom bar only ensures that the leading edge of the door stays in the vertical plane, and strong gusts of wind or large pressure differentials between sections of a building may still allow the remainder of the curtain to billow either during the curtain's travel, or when it is fully closed.

To prevent this undesirable movement of the door, many prior art doors provide wind retention by use of a tensioning means to place a vertically disposed tension on the door to prevent it from billowing out of the vertical plane. One example of such a tensioning means is a heavy bottom bar. The weight of the heavy bottom bar may provide sufficient vertical tension to prevent undesirable billowing particularly (although not exclusively) in a gravity-fall type door. Alternatively, external means may be used to provide the necessary tension. For example, belting is often used for this purpose. Typically, one end of the belting is attached to the roller, and is wound and unwound from the roller in the opposite sense from the curtain. The belt is then passed through a pulley mounted near the bottom of the side frame. The other end of the belt is then attached to the extensions of the bottom bar. As the belt is wound and unwound from the roller in an opposite sense to the curtain, it exerts a downward pulling force on the bottom bar and the side frame inserts thus placing the necessary vertical tension on the door. Other particular arrangements for the belting besides that previously described are also used to achieve the same purpose.

A further exemplary means for exerting the necessary vertical tension on the door, at least in the closed position, is a system wherein the extensions of the bottom bar are latched in position when the door is in the closed position. In the case of the powered roll-up door, the motor is then reversed to exert the necessary vertical tension of the door to hold it taut.

While the variety of methods just described for wind retention are generally effective in preventing this problem, they are not without their own disadvantages. For example, obstacles in the path of travel of the bottom bar may be problematic. If an obstacle is in place in this position, and the door continues its downward movement, damage to either the door or the object could occur. Further, if the obstacle should be personnel, goods or equipment either damage to the door, goods or equipment or injury to the personnel could result. To avoid this problem, doors employing bottom bars typically also include some type of sensing mechanism for determining when an obstacle has been encountered. These sensors are coupled to the motor which drives the roller, and cause the door to be reversed upon encountering an obstacle. Such sensors, however, may be subject to malfunction, and add both cost and complexity to the door.

SUMMARY OF THE INVENTION

It is thus a general aim of the invention to improve on the bottom bar mechanisms for use in pliable doors as compared to those that have been used heretofore.

In accordance with that aim, it is a primary object of the invention to provide a bottom bar for such all door that has enhanced safety features.

It is a related object to provide a bottom bar that will not cause or that will minimize injury or damage to obstructions that are encountered during downward travel of the door.

It is the further object of the invention to provide a bottom bar that is adjustable to meet the demands of the potentially changing environment in which the door is located.

It is a further object of the invention to provide a bottom bar which can be easily and inexpensively implemented and maintained.

Other objects and advantages of the invention will become apparent from the description to follow.

In accordance with these and other objects, there is provided a curtain bottom tensioning assembly comprised primarily of a resilient member extending across the bottom of the door. The resilient member is directly or indirectly coupled to a guide extension extending beyond the leading edge of the door and engaging vertical guide members to guide the door in a vertical plane. The guide extensions also engage the vertical guide members to restrict the guide extensions from moving horizontally toward the curtain. The coupling between these horizontally restricted guide extensions and the resilient member places a tension on the resilient member. The resilient member is thus stretched across the bottom of the door or curtain, and serves as a bottom bar. Unlike a typical bottom bar, however, upon impact with an obstruction the "soft" bottom bar according to the invention will substantially conform to or deflect around the obstruction, thus preventing or minimizing damage to the door, the bottom bar and the obstruction.

According to a preferred embodiment of the invention, the soft bottom bar is a resilient strap extending across the bottom of the door, and received within a pocket or flap formed on the door for that purpose. At either end of the door, the strap is received within a semi-rigid end stiffener. The end stiffener is adapted to engage a breakaway-type guide extension that is restricted in a horizontal direction. Included along the length of the resilient strap is a tightening member, allowing the tension and the resilient straps to be advantageously adjusted. With the breakaway guide extension mechanism attached to the semi-rigid end stiffeners, the resilient strap stretches across the bottom of the door, and serves the advantageous function of a soft bottom bar.

According to a further aspect of this preferred embodiment of the invention, the section of the door beneath the soft bottom bar includes a loop for receiving a ballast tube. The ballast tube is a tube of material filled with a compressible material such as sand or ground garnet, gel, silicone, a high viscosity liquid, etc. The ballast tube extends across the leading edge of the door and provides a way of keeping the door taut in a vertical direction. At the same time it provides a soft and pliable door bottom and yields an excellent bottom seal when the door is in the closed position.

According to another embodiment, the resilient member is the leading edge of the curtain itself, the curtain being formed of a material having sufficient tensile strength to perform this function.

DETAILED DESCRIPTION OF THE PREFERRED EMBODIMENTS

While the invention will be described in connection with certain preferred embodiments, there is no intent to limit it to those embodiments. On the contrary, the intent is to cover all alternatives, modifications and equivalents included within the spirit and scope of the invention as defined by the appended claims.

Figure 1:
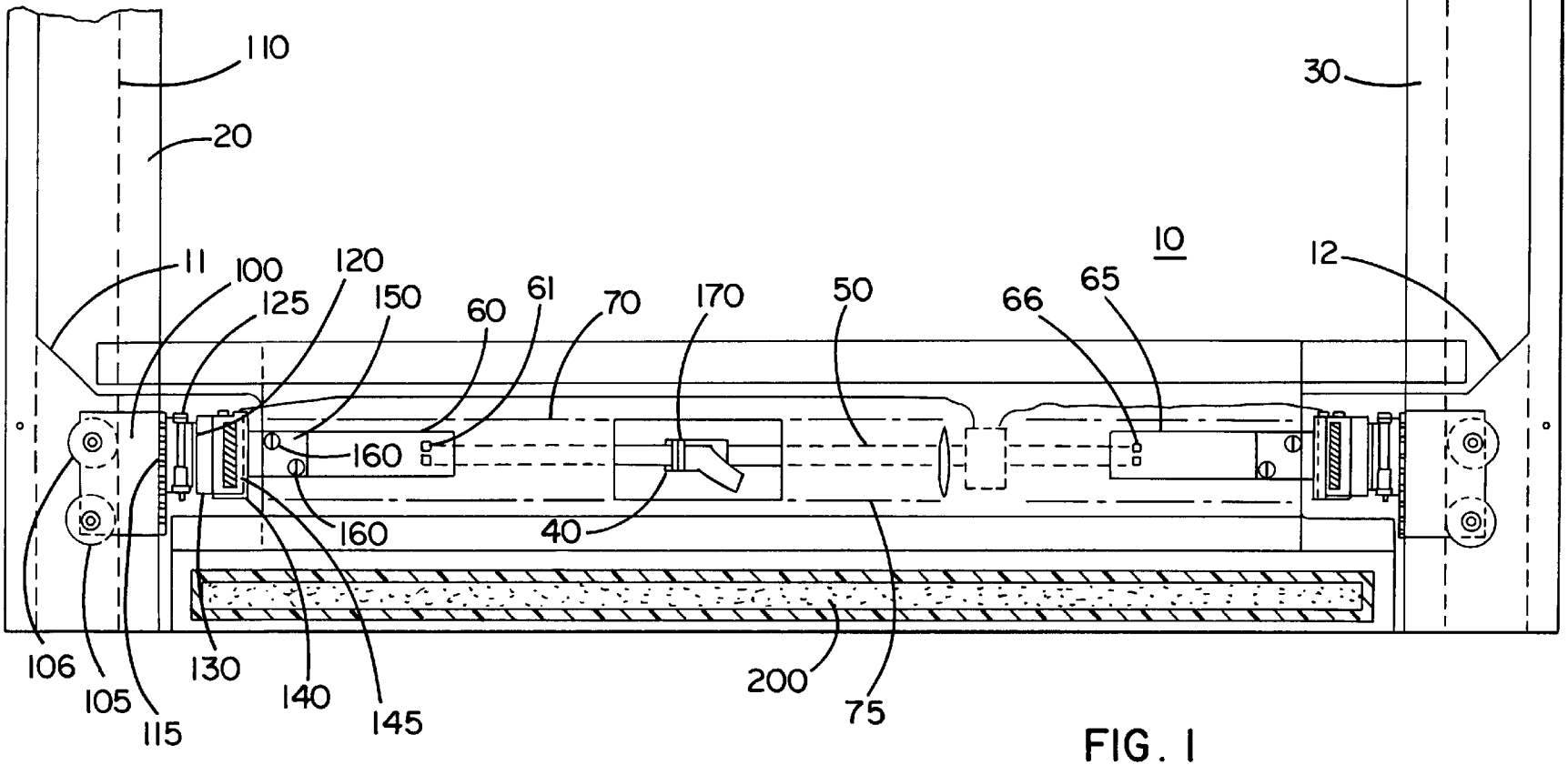
FIG. 1 is an elevational view of a curtain bottom tensioning assembly according to one embodiment of the invention, shown in connection with a breakaway side frame insert mechanism.

Turning now to FIG. 1, there is shown a curtain bottom tensioning assembly according to one preferred embodiment of the invention, particularly—a tensioning assembly on a roll-up door. As mentioned, however, the tensioning assembly may be used in combination with other industrial doors including planar doors and overhead storing doors. In this embodiment, the curtain bottom tensioning assembly includes a resilient member and other components mounted to a leading edge of the curtain door, and horizontally restrained side frame inserts which are coupled to the side frame inserts to place the resilient member across the bottom of the door in tension. The components across the bottom of the door will be referred to herein as a "soft bottom bar." The use of this term is not intended to be limiting, however. Rather, the invention broadly encompasses a curtain bottom tensioning assembly in the form of a horizontally restricted guide extensions coupled to a resilient member disposed along the leading edge of the door, regardless of whether discrete components are disposed along the bottom of the curtain, to form a bottom bar as in this embodiment, or whether the fabric of the door curtain itself forms the resilient member, as will be described in greater detail below.

The curtain bottom tensioning assembly of this embodiment is designed to be used with a conventional roll-up door including a fabric curtain 10, the leading edge of which is shown in FIG. 1. Vertical guide members, illustratively in the form of side frame members 20, 30, which support the roller upon which the curtain is wound, are disposed on either side of the door, and include vertical side channels which may receive the sides of the curtain above the bottom bar section, as well as guide extensions which are attached to the bottom bar, and are discussed in greater detail below. The curtain 10, in the area of the soft bottom bar, is preferably of reduced width, with the curtain narrowing for example in the sections 11, 12 shown in FIG. 1. The soft bottom bar, designated generally by the reference numeral 40 in FIG. 1 is shown disposed in this preferably narrower section of the curtain 10 at or near its bottom edge.

The soft bottom bar 40 is comprised primarily of a resilient member in the form of a strap 50 which extends across the bottom edge of the door. Other types of resilient members besides strap 50 could be used, such as resilient cable, rope and the like, with ⅛" braided steel rope being particularly preferred. To anchor the strap or other resilient member at either end of the door, and to provide added stiffness in that area, semi-rigid end stiffeners 60, 65 receive respective ends of the resilient strap 50. According to the present embodiment, end stiffeners 60, 65 are generally rectangular in shape, with their major axis extending along the horizontal width of the door. Each stiffener 60, 65 includes a slot 61, 66 which is sized to receive the width of the resilient strap 50. In this embodiment, the strap 50 is received within the slots 61, 66, near its respective ends. Each end of the strap is then sewn onto a portion of the strap 50 near the end stiffeners 60, 65 thus forming a loop of the strap 50 received within the slots 61, 66. In the present embodiment, strap 50 is actually two straps, one attached to stiffener 60, and one to stiffener 65. The two straps are coupled through a centrally-disposed tightening member 170, to be discussed in greater detail below. A variety of resilient materials may be used for the resilient strap 50. As will be discussed below, the strap 50 according to this embodiment will typically have a tension applied to it so as to stretch it illustratively 2–5% longer than its unstretched length. A resilient material providing such stretch without requiring undue force is thus required. At present, the best material we have found for use as strap 50 is a webbed belting material in the form of a 1 inch wide polyester belt, with a 1,000 pound rating. The belt is manufactured by S.I.R. Webbing, Inc; Model Number 17337. As mentioned, the preferred resilient cable, if used, is ⅛" braided steel rope, available from a variety of sources.

As can be seen from FIG. 1, the resilient strap 50 and the end stiffeners 60, 65 are preferably received within a pocket formed on the fabric curtain 10. As an alternative embodiment, resilient strap 50 could be sewn directly to the curtain fabric. In the embodiment of FIG. 1, this pocket is in two sections 70, 75 shown in broken lines. The pocket serves primarily to maintain the strap 50 and end stiffeners 60, 65 in the proper vertical position on the curtain 10.

According to the invention, guide extensions extend past either side of the door curtain and engage the vertical guide members to guide the door in a vertical plane. In the present embodiment, the guide extensions are in the form of side frame insert assemblies which are received within the vertical guide members in the form of side frames. The end stiffeners 60, 65 are preferably coupled to these side frame inserts which preferably also include having a breakaway feature. In the present embodiment, end stiffeners 60, 65 are coupled to magnetic breakaway side frame insert assemblies, as disclosed and claimed in U.S. patent application Ser. No. 08/386,436 which was filed concurrently with the parent application of this c-i-p. The details of that breakaway side frame insert are disclosed in that '436 application, which is incorporated herein by reference. While, in this preferred embodiment, a breakaway or indirect coupling between guide extensions and the resilient member is disclosed, the invention encompasses a non-breakaway or direct coupling as well.

Figure 2:
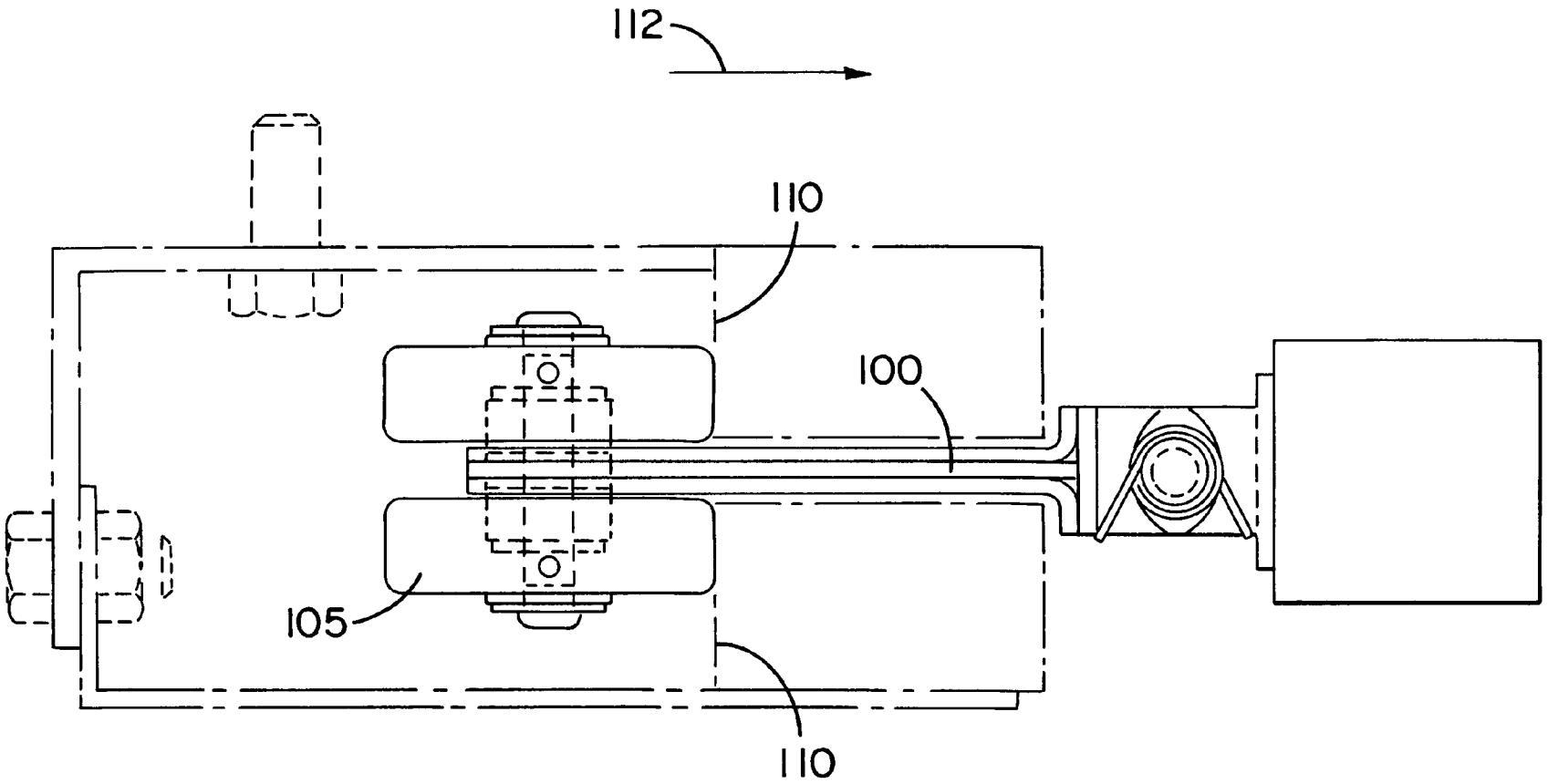
FIG. 2 is a top view of a horizontally restrained guide extension according to an embodiment of the invention.

A magnetic breakaway side frame insert according to the filed '436 application will be briefly described. Since the side frame inserts on either side of the door are the same, only one will be described. A side frame insert in the form of a trolley 100 is received within the side frame 20. The trolley is comprised primarily of a flat piece of metal or other rigid material, having trolley wheels 105, 106 secured to the front and back of the trolley, for free rotation therewith. The side frame 20 includes a horizontally extending projection, one of which is shown in a broken line at 110 in FIG. 1. The trolley wheels engage this projection 110, to guide the trolley in vertical movement within the side frame as the fabric curtain 10 is raised and lowered. This arrangement of trolley wheels and horizontal projection 110 can be seen more clearly in FIG. 2. Returning to FIG. 1, coupled to the plate of the trolley 100 is a first c-shaped bracket 115. A second c-shaped bracket 120 is received within the first c-shaped bracket 115, and they are hinged together by a hinge pin 125. Attached to the second c-shaped member 120 is a coupling magnet 130. The coupling magnet 130 is received within a cup assembly 140 comprised of plastic or other non-ferrous material. The cup assembly 140 receives a ferrous member 145 in its interior, which extends out the back of the cup and toward the bottom bar of the door curtain to which the magnetic breakaway mechanism is attached. In FIG. 1, the portion of the ferrous member extending out of the back of the cup is shown, and designated by reference number 150. This portion of the magnetic breakaway mechanism 150 is attached to the bottom bar of the roll-up door. With coupling magnet 130 received within magnetic cup assembly 140, and magnet 130 magnetically coupled to the ferrous member 145, the breakaway mechanism is assembled for operation. The side frame inserts just described break away when sufficient force is placed on the door, which overcomes the magnetic force coupling magnet 130 and ferrous member 150. As is described in significantly greater detail in the filed '436 application, this breakaway mechanism has the significant advantage of being omni-directional, and breaking away for a variety of directions and magnitudes of forces that are exerted on the door.

While the breakaway mechanism has been described in some detail, it does not form a part of the present invention directed to a curtain bottom tensioning assembly. Rather, the invention is directed to a curtain bottom tensioning assembly including a resilient member disposed along the leading edge of the door, and coupled to guide extensions which are horizontally restricted so that, upon coupling of the guide extensions to the resilient member, a tension is placed on the resilient member. In the exemplary guide extension in the form of a breakaway side frame insert, just described, the engagement of the trolley wheels 105, 106 with the horizontal projection 110 in side frame 20 restrict the trolley from horizontal movement in the direction of the arrow 112 of FIG. 2. One skilled in the art will appreciate that other horizontally restricted guide extensions, within the scope of the invention, may be advantageously employed. Such horizontally restricted guide extensions require contact between the extension and the vertical guide member to restrict the horizontal movement of the extension while also providing for smooth movement of the extension along the vertical guide member during travel of the door. In the present embodiment the side frame insert includes an engagement member, which engages the side frame to perform both of these functions. The engagement member in the present embodiment is in the form of the plurality of trolley wheels 105,106. Alternative designs of the insert could also achieve the functions of the engagement member. It should also be noted that the guide extension according to the invention need not include a breakaway function as in the side frame inserts of the filed '436 application. Further, while the presently-described break away mechanism provides for separation of the bottom bar and side frame insert outside of the side frame, the invention is not so limited. Rather, given the resilient nature of the bottom bar or tensioning assembly according to the invention, the resilient member itself could extend into the side frame, with breakaway between the resilient member and a side frame insert occurring inside the side frame.

As mentioned, a horizontally restricted guide extension like that of the present embodiment forms an aspect of the invention only in that it allows a tension to be applied to the strap 50 upon attachment of the soft bottom bar to the respective guide extensions or inserts. This attachment is achieved, according to the present embodiment, by means of end stiffener 60 being coupled to the magnetic breakaway side frame insert by means of bolts 160 which couple, for example, the ferrous member 150 to the end stiffener 60. With end stiffener 60 coupled to the side frame insert, the stiffener 60 and resilient strap 50 (along with the other end stiffener/insert member combination) along with cup assembly 140 comprise the bottom bar across the bottom of curtain 10 which attaches the curtain to the side frame inserts, and also serves to stiffen the bottom edge of the curtain to provide wind retention. According to the invention, strap 50 has an unstretched length before attachment of the cup assembly 140 to horizontally restricted side frame inserts. The strap 50 is then stretched to a length illustratively 2–5% longer than its unstretched length. This loading or stretching of resilient strap 50 upon securement to the horizontally restricted inserts ensures that the strap is taut enough across the bottom of the door to perform the desirable bottom bar functions including wind retention.

At the same time, however, and according to a significant aspect of the invention, the bottom bar according to this embodiment can substantially conform to or deflect around obstacles. That is, upon the soft bottom bar encountering an obstacle, the presence of either the resilient strap 50 or another resilient member instead of a rigid member, as is conventional, allows the soft bottom bar to substantially conform to or deflect around whatever obstacle is encountered. By use of the term "substantially conform to or deflect around" it is intended to convey that the engagement between a soft bottom bar according to this embodiment and an obstacle can result in the bottom bar taking on several possible configurations. This function is provided for by the fact that the bottom bar is in the form of a resilient member as opposed to a rigid member, as is conventional. The soft bottom bar may "substantially conform" to an obstacle by the profile of the bottom bar taking on the profile of the obstacle. Of course, depending on the height of the obstacle above the floor, such "conforming" of the bottom bar may only take place over a portion of the obstacle. However, if the object is close enough to the floor, the bottom bar may be entirely conformed about the outer upper surfaces of the obstruction. In such a situation, the soft bottom bar is designed to allow, for example, the obstruction to be pulled out from underneath the door, with the bottom bar conformed around it in this configuration. This ability to remove the obstruction without a need for stopping and reversing the direction of the door is advantageous. Further, the resiliency of the bottom bar prevents the obstacle from being crushed by continued downward travel of the door to the floor, as might be the case with a conventional, rigid, bottom bar. In other situations, the soft bottom bar according to this embodiment may "deflect" about the obstruction. For example, if the obstruction only minimally projects into the plane of the door, the descending bottom bar may engage a surface of the obstacle, and then, by virtue of the resilient nature of the bottom bar, deflect about the obstacle such that the bottom bar and door may continue downward, albeit in a slightly different plane then that in which the door was traveling prior to encountering the obstruction. Whether the door conforms to or deflects about the article will depend on which of these represents the path of least resistance to the continued travel of the door. The provision of both "conforming" and "deflecting" of the soft bottom bar according to this embodiment significantly enhances the safety of this bottom bar as compared to rigid, non-deflecting and non-deforming bottom bars. Further, the need for a sensing means for immediately stopping or reversing the door upon contact with an obstruction may be eliminated. When the soft bottom bar is advantageously used with the omni-directional breakaway side frame insert according to filed U.S. patent application Ser. No. 08/386,436 which was filed concurrently with the parent application of this c-i-p, breakaway of the soft bottom bar may occur as the bottom bar conforms to the obstructing object.

To provide adjustability to the tension in the soft bottom bar, an adjustable tightening member 170 is included in this preferred embodiment. Such adjustability may be desirable, for example, when increased wind retention is necessitated by changing environmental or atmospheric conditions. In the present embodiment, tightening member 170 is in the form of a buckle which receives ends of two sections of the resilient strap 50, and is adjustable and securable along the lengths thereof. According to an alternative embodiment, the resilient strap 50 may be a single strap extending through both slots 61, 66 with the two ends attached to or engaged with tightening member 170. The presence of an adjustable tightening member allows the tension of the resilient belt 50 or other resilient member to be adjusted as may be desirable for a given environment. With the respective ends of the adjustable soft bottom bar coupled to horizontally restrained side frame inserts, the tension on the resilient strap 50 can be increased without the risk of pulling the side frame inserts inwardly so that they no longer engage the side frame. Further, if the adjustable soft bottom bar according to the invention is used with a magnetic breakaway side frame insert as described in concurrently filed U.S. patent application Ser. No. 08/386,436 which was filed concurrently with the parent application of this c-i-p, the magnetic coupling may be advantageously adjusted in order to allow the desired tension to be placed on the resilient strap 50. With stronger magnetic coupling between the coupling magnet 130 and ferrous member 150, increased tension may be placed on the resilient strap 50. As previously noted, under typical circumstances it is assumed that resilient strap 50, or whatever resilient member is used, will only be stretched in the range of 2–5 percent of its length when it is coupled to whatever side frame insert is used in combination with the soft bottom bar. The presence of the tightening member 170 allows adjustment of this stretch amount as may be desired.

Figure 3:
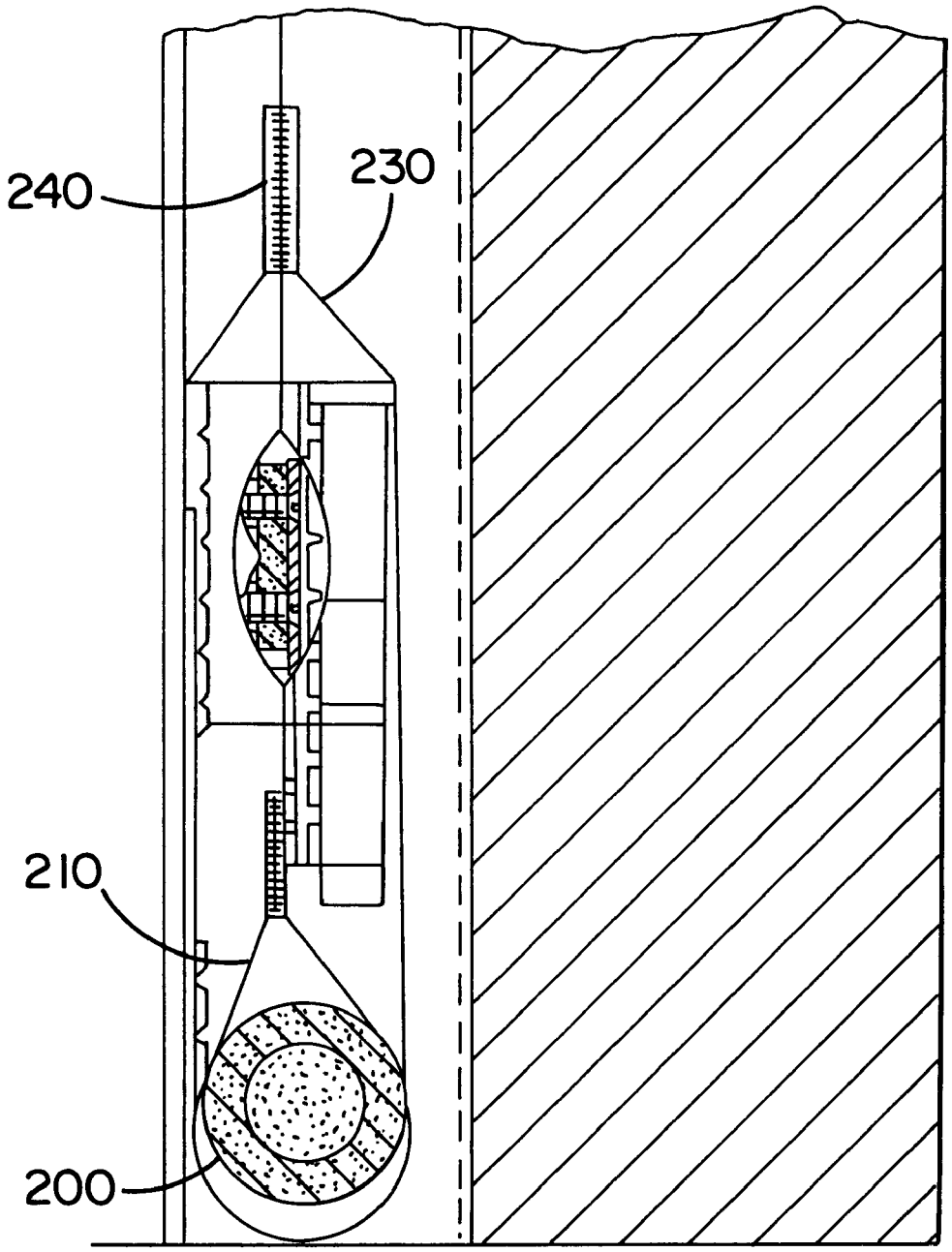
FIG. 3 is an end view of the leading edge of a roll-up door including a curtain bottom tensioning assembly and ballast tube according to the invention.

The soft bottom bar according to this preferred embodiment of the invention also advantageously includes a ballast tube 200. According to a preferred embodiment, the ballast tube 200 is in the form of a resilient hosetype material filled with a compressible material such as sand, ground garnet, gel, silica, etc. which will allow the ballast tube to substantially conform to or deflect when the ballast tube contacts either the floor beneath the door opening, or an obstacle. With the hose material filled with sand, or one of the other listed compressible materials, the ballast tube 200 takes on a generally circular cross section, seen most clearly in the end view of FIG. 3. According to the preferred embodiment, ballast tube 200 is received within a loop 210 formed by the bottom of the curtain being doubled back upon itself although the ballast tube could be located at other positions of the door, including above resilient strap 50. The leading edge of the curtain and a portion of the curtain above the ballast tube 200 may advantageously be provided with complemental strips of Velcro® type fasteners. Of course, other means for forming the loop 210 in the bottom of the curtain may also be used. Ballast tube 200 is advantageous in that it provides weight on the bottom of the door. This is particularly advantageous if the soft bottom bar according to the invention is used in a gravity-fall door. In that situation, the weight of the ballast tube keeps the curtain taut in the vertical direction. At the same time, the ballast tube 200 filled with granular material is soft and pliable. Thus, the ballast tube 200 would also substantially conform to or deflect around any encountered obstacles like the soft bottom bar 20 according to the invention. Moreover, the deformable ballast tube 200, when engaging the floor beneath the door in the closed position, provides an excellent seal preventing the escape or entrance of air beneath the bottom of the door.

To protect the leading edge of the curtain, the soft bottom bar 40, and the ballast tube 200 from undue wear, a loop seal 230 is preferably provided. According to the present embodiment, the loop seal is simply a piece of fabric, which is the same fabric of which curtain 20 is comprised although other materials could be used. As is seen most clearly from the side view of FIG. 3, the two ends of the loop seal are secured to the curtain at 240. Preferably, each end of the loop seal 230 is provided with Velcro®, and a strip of Velcro® is provided on both sides of the door as at 240 in FIG. 1. Loop seal 230 surrounds and protects the various components held within it.

As mentioned above, the soft bottom bar and horizontally restricted side frame inserts just described are only a representative embodiment of the curtain bottom tensioning assembly according to the invention. In alternative embodiments, discrete components forming a "soft bottom bar" along the leading edge of the door are not required. All that is required according to the invention, is a resilient member disposed at the leading edge of the door, and directly or indirectly coupled to horizontally restricted guide extensions which extend past the sides of the door, and engage vertical guide members to guide the door in a vertical plane, and to restrict the guide extensions from moving horizontally toward the door curtain. In the case of the "soft bottom bar" just described, the resilient member was the strap 50. According to an alternative embodiment, however, the resilient member may be leading edge of the curtain itself. This would require the curtain to be formed of a material having sufficient tensile strength and resiliency to perform the advantageous function of substantially conforming to or deflecting about encountered obstacles while under tension. One example of a suitable curtain material which would meet this criteria is manufactured by Seaman, and has part number 3150 (MFRLTA) and another is made by the same manufacturer and bears part number 8138XR-40. In such an embodiment, this resilient curtain fabric is stretched and the curtain ends are secured to the horizontally restricted guide extensions to form a curtain bottom tensioning assembly according to the invention. The tension applied to the leading edge of the curtain could be adjusted, for example, by changing the relative position of the point where the guide extensions are attached to the curtain.

Any of the various embodiments of the invention, which can be envisioned by one skilled in the art, share the common feature of tension being applied in the area of the leading edge of the curtain by means of a resilient member coupled to horizontally restricted guide extensions. Such curtain bottom tensioning assemblies are designed to substantially conform to or deflect around encountered obstacles, while still giving the curtain advantageous functional features typically associated with a rigid bottom bar, including wind retention. Since a curtain bottom tensioning assembly according to the invention substantially conforms to or deflects around any obstructions which it may encounter, the need for sensors to sense such obstructions, and signal the need for stopping or reversal of the door, is eliminated. Other advantages of the invention will be apparent to those skilled in the art.

What is claimed is:

1. A curtain bottom tensioning assembly disposed along a leading edge of a movable curtain, the curtain selectively blocking and unblocking a doorway and including a center, the doorway having generally vertical guide members disposed on either side thereof, the curtain bottom tensioning assembly comprising, in combination:

a member comprising resilient material and mountable adjacent the leading edge of the curtain;

guide extensions coupled to opposed ends of the resilient member, the guide extensions engaging the vertical guide members to guide the curtain in a generally vertical plane, the guide extensions also engaging the vertical guide members to restrict each guide extension from movement toward the curtain center; the restricted guide extensions being coupled to the resilient member to place a tension on the resilient member;

at least one of the guide extensions being detachably coupled to the resilient member by a breakaway mechanism which provides for separation of the resilient member and the at least one guide extension when a force above a predetermined magnitude is applied to the curtain, whereby the tensioned resilient member acts as a wind retention bottom bar that can substantially conform to or deflect about encountered obstacles.

2. The curtain bottom tensioning assembly of claim 1, wherein the resilient member comprises a resilient strap of webbed belting material.

3. The curtain bottom tensioning assembly of claim 2, wherein the resilient strap includes a tightening member disposed to adjust the tension on the resilient strap.

4. The curtain bottom tensioning assembly of claim 2, wherein the resilient strap is coupled at either end to an end stiffener, each end stiffener being coupled to one of the guide extensions.

5. The curtain bottom tensioning assembly of claim 2, wherein the resilient strap is received within a flap of material which is fixed to the curtain to form a pocket.

6. The curtain bottom tensioning assembly of claim 2, wherein a ballast tube is disposed generally horizontally on the curtain, the ballast tube being disposed beneath the resilient member and between the vertical guide members.

7. The curtain bottom tensioning assembly of claim 6, wherein the ballast tube comprises a pliable tube filled with a compressible material.

8. The curtain bottom tensioning assembly of claim 6, wherein the ballast tube is received within a pocket formed by looping the leading edge of the curtain upon itself.

9. The curtain bottom tensioning assembly of claim 6, wherein a loop seal comprising a length of material is fixed to the curtain to enclose the resilient member and the ballast tube.

10. A curtain bottom tensioning assembly disposed on a curtain member having a bottom edge and opposed side edges, the curtain member including a center and being selectively movable between a blocking position and an unblocking position with respect to a doorway, the doorway having generally vertical guide members disposed on either side thereof, the curtain bottom tensioning assembly comprising:

a member comprising resilient material and mountable adjacent said bottom edge and between the vertical guide members and extending at least partially laterally between the opposed side edges of the curtain member; and guide extensions engaging the vertical guide members of the doorway and coupled to opposed ends of the resilient member for guiding the curtain member in a generally vertical plane as the curtain member moves between the blocking and unblocking positions, the guide extensions being restricted from horizontal movement toward the curtain center by the vertical guide members and the resilient member being tensioned between the guide extensions, the tensioned resilient member causing the bottom edge of the curtain member to deflect around or to conform, at least in part, to encountered obstacles;

at least one of the guide extensions being detachably coupled to the resilient member by a breakaway mechanism which provides for separation of the resilient member and the at least one guide extension when a force above a predetermined magnitude is applied to the curtain.

11. The curtain bottom tensioning assembly of claim 10, wherein the resilient member is spaced apart from the bottom edge of the curtain member.

12. The curtain bottom tensioning assembly of claim 10, wherein the curtain member includes a laterally-extending pocket disposed upwardly from the bottom edge for receiving the resilient member.

13. The curtain bottom tensioning assembly of claim 10, wherein the bottom edge of the curtain member includes a pliable ballast tube which is disposed inboard of the vertical guide members and is filled, at least in part, with a compressible material.

14. The curtain bottom tensioning assembly of claim 10, wherein the resilient member comprises a strap of resilient material, the strap including a tightening member for adjusting tension thereon.

15. The curtain bottom tensioning assembly of claim 10, wherein the resilient member comprises a resilient strap of webbed belting material.

16. The curtain bottom tensioning assembly of claim 10, wherein at least one end of the resilient member includes a stiffener with an attached ferrous member and the at least one guide extension includes a magnet, the ferrous member being magnetically releasably coupled to the magnet of the at least one guide extension to enable the resilient member to breakaway from the guide extensions when forces above a predetermined magnitude are applied to the curtain.

17. The curtain bottom tensioning assembly of claim 15, wherein the breakaway mechanism comprises a magnet disposed on the at least one guide extension and a ferrous member attached to an end of the strap.

18. A curtain bottom tensioning assembly disposed on a curtain having a bottom edge and opposed side edges, the curtain having a center and being selectively movable between a blocking position and an unblocking position with respect to a doorway, the doorway having generally vertical guide members disposed on either side thereof, the curtain bottom tensioning assembly comprising:

a member comprising resilient material and mountable adjacent said bottom edge and extending at least partially between the opposed side edges of the curtain; and guide extensions engaging the vertical guide members of the doorway and coupled to opposed ends of the resilient member for guiding the curtain in a generally vertical plane as the curtain moves between the blocking and unblocking positions, the guide extensions being restricted from movement toward the curtain center by the vertical guide members and the resilient member being tensioned between the guide extensions, the tensioned resilient member causing the bottom edge of the curtain to deflect around or to conform, at least in part, to encountered obstacles;

at least one of the guide extensions being detachably coupled to the resilient member by a breakaway mechanism which provides for separation of the resilient member and the at least one guide extension when a force above a predetermined magnitude is applied to the curtain.

19. The curtain bottom tensioning assembly of claim 1, wherein the breakaway mechanism provides for separation of the resilient member and the at least one guide extension when forces above a predetermined magnitude are applied both into and in the plane of the curtain.

20. The curtain bottom tensioning assembly of claim 1, wherein the breakaway mechanism provides for separation of the resilient member and the at least one guide extension when forces above a predetermined magnitude are applied in the plane of the curtain.

21. The curtain bottom tensioning assembly of claim 10, wherein the breakaway mechanism provides for separation of the resilient member and the at least one guide extension when forces above a predetermined magnitude are applied both into and in the plane of the curtain.

22. The curtain bottom tensioning assembly of claim 10, wherein the breakaway mechanism provides for separation of the resilient member and the at least one guide extension when forces above a predetermined magnitude are applied in the plane of the curtain.

23. The curtain bottom tensioning assembly of claim 16, wherein the breakaway mechanism provides for separation of the resilient member and the at least one guide extension when forces above a predetermined magnitude are applied both into and in the plane of the curtain.

24. The curtain bottom tensioning assembly of claim 18, wherein the breakaway mechanism provides for separation of the resilient member and the at least one guide extension when forces above a predetermined magnitude are applied in the plane of the curtain.

25. A releasable assembly disposed on an industrial door, the door selectively blocking and unblocking a doorway and generally defining a plane when in a blocking position, the doorway including a guide member disposed laterally on a side thereof for guiding the door between the blocking position and an unblocking position, the releasable assembly comprising:

a curtain having a center and a leading edge, a member extending laterally across the curtain and disposed adjacent the leading edge thereof, the member being mountable to the curtain to provide local upward deformation for a force applied thereto in the plane of the curtain and to provide a return to an undeformed state after the force is removed;

a guide extension coupled to the laterally-extending member and engageable with the guide member of the doorway to guide the curtain between the blocking and unblocking positions and to restrict the guide extension from movement toward the curtain center;

the guide extension being detachably coupled to the laterally-extending member, the detachable coupling providing release of the guide extension and the member when a force above a predetermined magnitude is applied to the curtain in a direction substantially in the plane of the door.

26. The releasable assembly of claim 25, wherein the laterally-extending member is comprised of a resilient material.

* * * * *

UNITED STATES PATENT AND TRADEMARK OFFICE

CERTIFICATE OF CORRECTION

PATENT NO. : 5,915,448

DATED : June 29, 1999

INVENTOR(S) : Peter S. Schulte

It is certified that error appears in the above-identified patent and that said Letters Patent is hereby corrected as shown below:

Col. 12, line 25 after "....assembly of claim" please delete "16" and insert -- 18 --.

Signed and Sealed this

Twenty-first Day of December, 1999

*Attest:*

Q. TODD DICKINSON

*Attesting Officer*

*Acting Commissioner of Patents and Trademarks*